US012638177B2

(12) United States Patent
Zhou et al.

(10) Patent No.: US 12,638,177 B2
(45) Date of Patent: May 26, 2026

(54) LIGHTER FUELED BY POCKET LIGHTER OR GAS RESERVOIR

(71) Applicant: SOCIÉTÉ BIC, Clichy Cedex (FR)

(72) Inventors: Boy Zhou, Zhejiang (CN); Rene Frigiere, Clichy Cedex (FR)

(73) Assignee: SOCIÉTÉ BIC, Clichy Cedex (FR)

( * ) Notice: Subject to any disclaimer, the term of this patent is extended or adjusted under 35 U.S.C. 154(b) by 377 days.

(21) Appl. No.: 18/246,268

(22) PCT Filed: Sep. 21, 2021

(86) PCT No.: PCT/EP2021/075855
§ 371 (c)(1),
(2) Date: Mar. 22, 2023

(87) PCT Pub. No.: WO2022/063737
PCT Pub. Date: Mar. 31, 2022

(65) Prior Publication Data

US 2023/0358401 A1 Nov. 9, 2023

(30) Foreign Application Priority Data

Sep. 23, 2020 (EP) ..... 20315417

(51) Int. Cl.

| | |
|---|---|
| ***F23Q 2/167*** | (2006.01) |
| ***F23Q 2/173*** | (2006.01) |
| ***F23Q 2/28*** | (2006.01) |
| ***F23Q 2/42*** | (2006.01) |

(52) U.S. Cl.
CPC ..... *F23Q 2/167* (2013.01); *F23Q 2/173* (2013.01); *F23Q 2/287* (2013.01); *F23Q 2/42* (2013.01)

(58) Field of Classification Search
CPC . F23Q 2/16; F23Q 2/167; F23Q 2/287; F23Q 2/42; F23Q 2/173
See application file for complete search history.

(56) References Cited

U.S. PATENT DOCUMENTS 4,222,734 A * 9/1980 Nolf ..... F23Q 21/00 431/344
4,253,820 A * 3/1981 Jarreau ..... F23Q 2/16 126/25 B
4,859,174 A 8/1989 Zellweger et al.
(Continued)

FOREIGN PATENT DOCUMENTS

CN 1251161 A 4/2000
CN 1349601 A 5/2002
(Continued)

OTHER PUBLICATIONS

European Search Report issued in European Application No. 20315417.4 on Feb. 15, 2021 (9 pages).
(Continued)

*Primary Examiner* — Alfred Basichas
(74) *Attorney, Agent, or Firm* — Bookoff McAndrews, PLLC

(57) ABSTRACT

A lighter comprises a housing having a nozzle, wherein the housing is adapted to receive a gas and/or fuel reservoir device. The lighter comprises a connecting device, wherein the connecting device is configured to couple the gas and/or fuel reservoir device to the nozzle. The connecting device is adjustable along a longitudinal axis of the lighter.

20 Claims, 7 Drawing Sheets

(56) References Cited

U.S. PATENT DOCUMENTS

| | | | | |
|---|---|---|---|---|
| 5,082,440 | A * | 1/1992 | Yamamoto | F23Q 2/32 431/255 |
| 5,222,889 | A | 6/1993 | Hsu | |
| 5,520,197 | A | 5/1996 | McDonough et al. | |
| 5,531,592 | A | 7/1996 | Tasi | |
| 5,934,895 | A * | 8/1999 | McDonough | F23Q 2/287 431/255 |
| 6,095,799 | A | 8/2000 | McDonough et al. | |
| 6,428,309 | B1 * | 8/2002 | Doiron | F23Q 2/287 431/153 |
| 7,815,432 | B2 | 10/2010 | Smith | |
| 2008/0220385 | A1 | 9/2008 | Mochizuki et al. | |

FOREIGN PATENT DOCUMENTS

| | | | |
|---|---|---|---|
| DE | 3151528 | A1 | 7/1983 |
| DE | 29706804 | U1 | 11/1997 |
| DE | 19721667 | A1 | 1/1999 |
| GB | 2156499 | A | 10/1985 |

OTHER PUBLICATIONS

International Search Report and Written Opinion issued in International Application No. PCT/EP2021/075855, on Jan. 12, 2022 (18 pages).

* cited by examiner

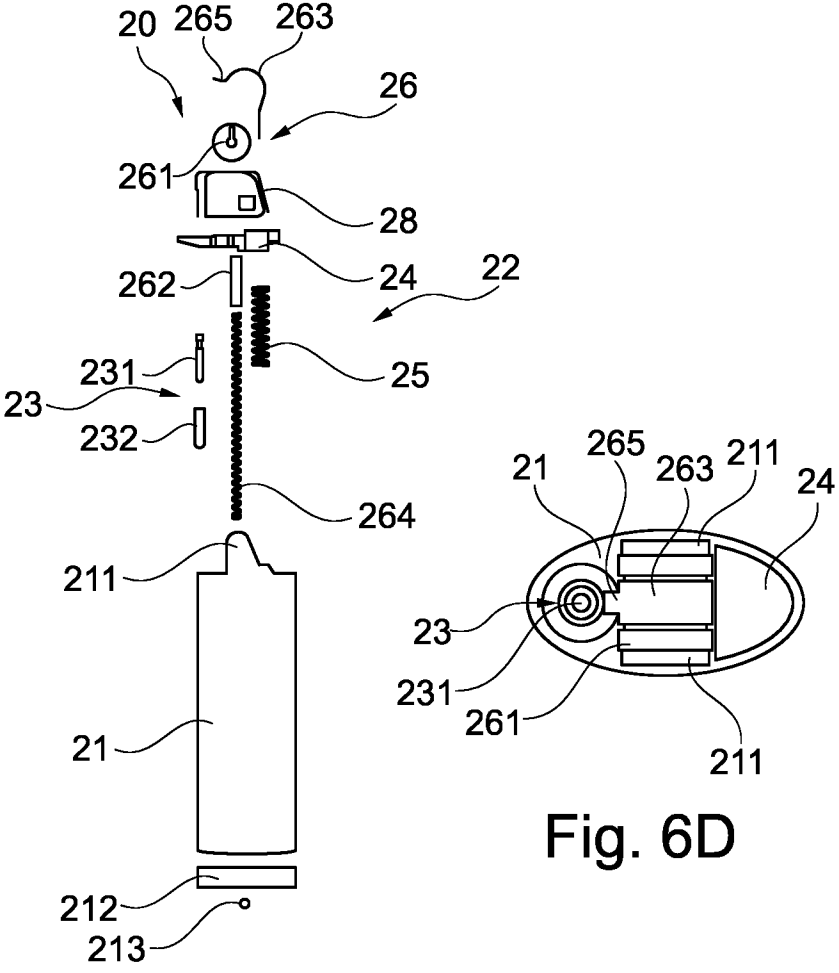
Fig. 6C
Fig. 6D
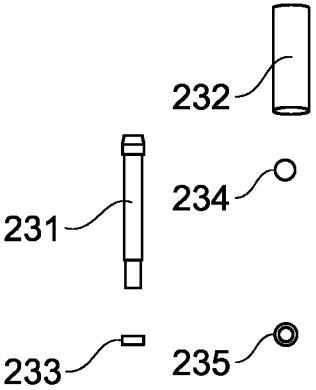
Fig. 6B
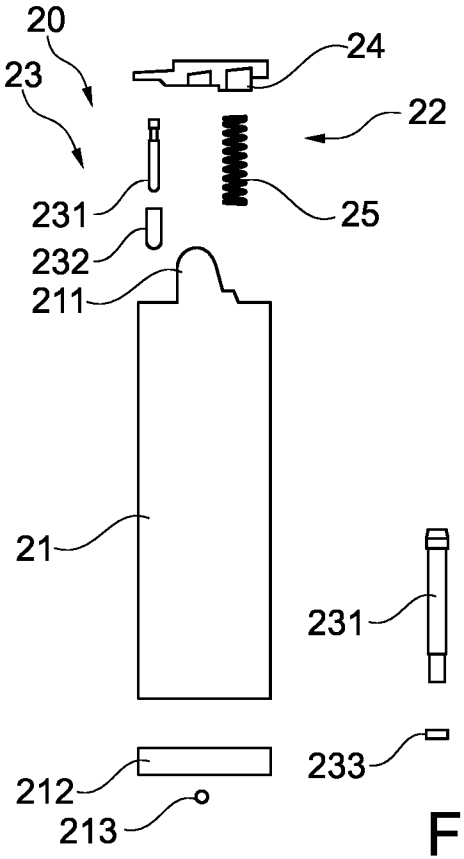
Fig. 6A

LIGHTER FUELED BY POCKET LIGHTER OR GAS RESERVOIR

CROSS-REFERENCE TO RELATED APPLICATIONS

This is a National Stage Application under 35 U.S.C. § 371 of International Application No. PCT/EP2021/075855, filed Sep. 21, 2021, now published as WO 2022/063737, which claims the benefit of priority to European Patent Application No. 20315417.4, filed on Sep. 23, 2020, its content being incorporated herein by reference.

TECHNICAL FIELD

The present disclosure relates to the field of lighters, more specifically to a lighter coupleable to geometrically different gas and/or fuel reservoir devices.

BACKGROUND

Lighters used for igniting purposes like igniting tobacco, cigars and/or cigarettes have been developed over the past years. These lighters have a fuel reservoir and either a rotary friction element or a piezoelectric ignition device to generate a spark at a nozzle which emits the fuel delivered by the fuel reservoir. Lighters are commercially available in different forms and sizes, for example as a small pocket lighter such as the BIC Maxi J26. Lighters have also evolved from the small pocket lighters to several forms of extended lighters that are more useful for general purposes, for example lighting candles, barbecue grills, fireplaces and/or campfires such as the BIC MegaLighter U160. Earlier attempts at such designs relied simply on extended actuating handles to house a typical lighter at the end. However, gas and/or fuel sources of a lighter can also be in the form of gas and/or fuel reservoirs permanently installed in the lighter. There are lighters that are non-refillable and are disposed of when the gas and/or fuel reservoir is empty. In such lighters, a non-commercially available fuel and/or gas reservoir, e.g. the BIC J6S3 GR, can be built into as a sub-assembly by the manufacturer.

Nowadays, however, lighters are in great demand which are refillable, for example for financial and environmental reasons. Such lighters can be refilled, for example, with a separate gas lighter refill, often sold as a can having an adapter to refill the gas and/or fuel reservoir of the lighter. However, it is desirable that gas and/or fuel refill operations are easy to manage, safe and inexpensive. Furthermore, it would be desirable to provide a lighter without a permanently attached gas and/or fuel reservoir, but which is able to couple with an interchangeable and commercially available lighter and/or with an interchangeable, non-commercially available gas and/or fuel reservoir for supplying gas and/or fuel to the lighter. More specifically, with such a lighter a user could safely provide gas and/or fuel to the lighter without discarding any usable parts, as compared to a common non-refillable lighter. Thus, a pocket lighter (e.g., BIC Maxi J26) can not only be used independently as a lighter, but also as a gas and/or fuel source. However, since commercially available lighters (e.g., BIC Maxi J26) and non-commercially available gas and/or fuel reservoirs (e.g., BIC J6S3 GR) differ in its geometrical and structural dimensions, it becomes difficult to selectively couple both variations to a lighter.

The object of the present disclosure is to provide an easy, safe and inexpensive gas and/or fuel refill and/or supply for a lighter. More specifically, the object of the present disclosure is to provide a lighter which can be coupled to geometrically different gas and/or fuel reservoirs devices.

SUMMARY

The present disclosure relates to a lighter according to claim 1. The dependent claims depict embodiments of the present disclosure.

According to a first aspect of the present disclosure, a lighter comprises a housing having a nozzle. The housing is adapted to receive a gas and/or fuel reservoir device. Furthermore, the lighter comprises a connecting device which is configured to couple the gas and/or fuel reservoir device to the nozzle. The connecting device is adjustable along a longitudinal axis of the lighter such that the lighter can be coupled to different gas and/or fuel reservoir devices having different geometrical and/or structural dimensions. Since the connecting device is adjustable, the lighter can be coupled to variations of gas and/or fuel reservoir devices which might have different geometrical and structural dimensions. As an example, the lighter according to the present disclosure can be selectively coupled to a commercially available pocket lighter or to a non-commercially available gas and/or fuel reservoir. Thus, a lighter can be provided with an easy, safe and inexpensive refill and/or supply of gas and/or fuel. Furthermore, an eco-friendly lighter can be provided because less components have to be disposed of as compared to a non-refillable lighter.

In this document, a lighter can be defined as being a portable combustion product and/or a flame producing assembly. Such products and/or assemblies are generally designed to produce a flame out of the combustion of a flammable material, when ignited by an ignition device, that can be integrated to the lighter. The flammable material can be stored within the portable combustion product and/or flame producing assembly, for example in a container comprised within or at the housing of the lighter. The flammable material used in lighters can be liquefied gas, for example liquefied hydrocarbon of the n-butane, isobutane, propane type or a mixture of these gases commonly named liquefied petroleum gas (LPG). The portable combustion products and/or flame producing assemblies are widely used for igniting a variety of combustible materials and items such as cigarettes, candles, flammable gas (e.g., in gas stoves), fireplaces, and many others. Portable combustion products and/or flame producing assemblies and/or lighters can be commercially available in different forms and sizes.

The lighter can comprise a longitudinal axis, wherein the connecting device can be adjustable along the longitudinal axis. This means that a size or dimension of the connecting device along the longitudinal axis is variable. More specifically, the connecting device may be adjustable by at least 0.5 mm, in particular by at least 0.7 mm, along the longitudinal axis.

Furthermore, the connecting device can be adjustable between a fully extended position and a fully retracted position. The distance between the fully extended position and the fully retracted position may be in the range of 0.5 to 15 mm, in particular in the range of 0.7 to 10 mm, more specifically in the range of 0.8 to 8 mm.

The connecting device can comprise a biasing element, more specifically a compression spring, wherein the biasing element can bias the connecting device in the direction of the longitudinal axis.

In the fully extended position as described above, the biasing element may have a biasing force of at least 40%, more specifically of at least 50%, in particular of at least 60%, compared to the biasing force in the fully retracted position.

The connecting device can be adjustable transverse to the longitudinal axis, wherein the connecting device may be adjustable by an angle α of at least 5°, more specifically by at least 7°, in particular by at least 10°, measured between the longitudinal axis of the lighter and a longitudinal axis of the connecting device.

The connecting device may comprise a cylindrical connecting body having a length and a diameter. The connecting body may have an outer circumferential surface, a first end face and a second end face. Furthermore, the connecting body may comprise an opening, defining an inner circumferential surface.

The connecting body can comprise a chamfer arranged between first end face and outer circumferential surface. The chamfer may extend at least partially over the circumference of the connecting body. The chamfer should be understood as a slope cut arranged at a right-angled portion or any other place where two surfaces meet at a sharp angle. In particular the chamfer is a slope cut or portion arranged between the first end face and the outer circumferential surface.

The connecting body can comprise a recess extending at least partially over the outer circumferential surface. The recess may extend at least partially over the length of the connecting body.

The recess and the chamfer or slope cut as described above may be substantially aligned to each other on the outer circumferential surface with respect to the longitudinal axis of the connecting device. The recess and the chamfer may be oriented toward a center of the lighter.

Starting from the first end face of the connecting body along the longitudinal axis, the connecting body may comprise the chamfer, followed by a section of the diameter as mentioned above, followed by the recess.

The housing may comprise a support element configured to receive and support the connecting device. The connecting device may be movably received by the support element.

According to a second aspect of the present disclosure, a lighter is provided according to the first aspect of the present disclosure, but which can further comprise a gas and/or fuel reservoir device coupled to the lighter. The gas and/or fuel reservoir device may be configured to be replaceably coupled to the lighter.

The gas and/or fuel reservoir device may comprise a fluid reservoir and a valve assembly for selectively dispensing fuel and/or gas, more specifically wherein the connecting device may be configured to be coupled to the valve assembly in a fluid-tight manner.

For all aspects and embodiments as described above, the gas and/or fuel reservoir device may be configured to be independently used as a lighter.

BRIEF DESCRIPTION OF THE DRAWINGS

Other characteristics will be apparent from the accompanying drawings, which form a part of this disclosure. The drawings are intended to further explain the present disclosure and to enable a person skilled in the art to practice it. However, the drawings are intended as non-limiting examples. Common reference numerals on different figures indicate like or similar features.

FIGS. 6A to 6D are exploded views of two different gas and/or fuel reservoir devices that can be coupled to the lighter, each having a valve assembly.

DETAILED DESCRIPTION

Embodiments of the lighter according to the present disclosure will be described in reference to the drawings as follows.

Figure 1:
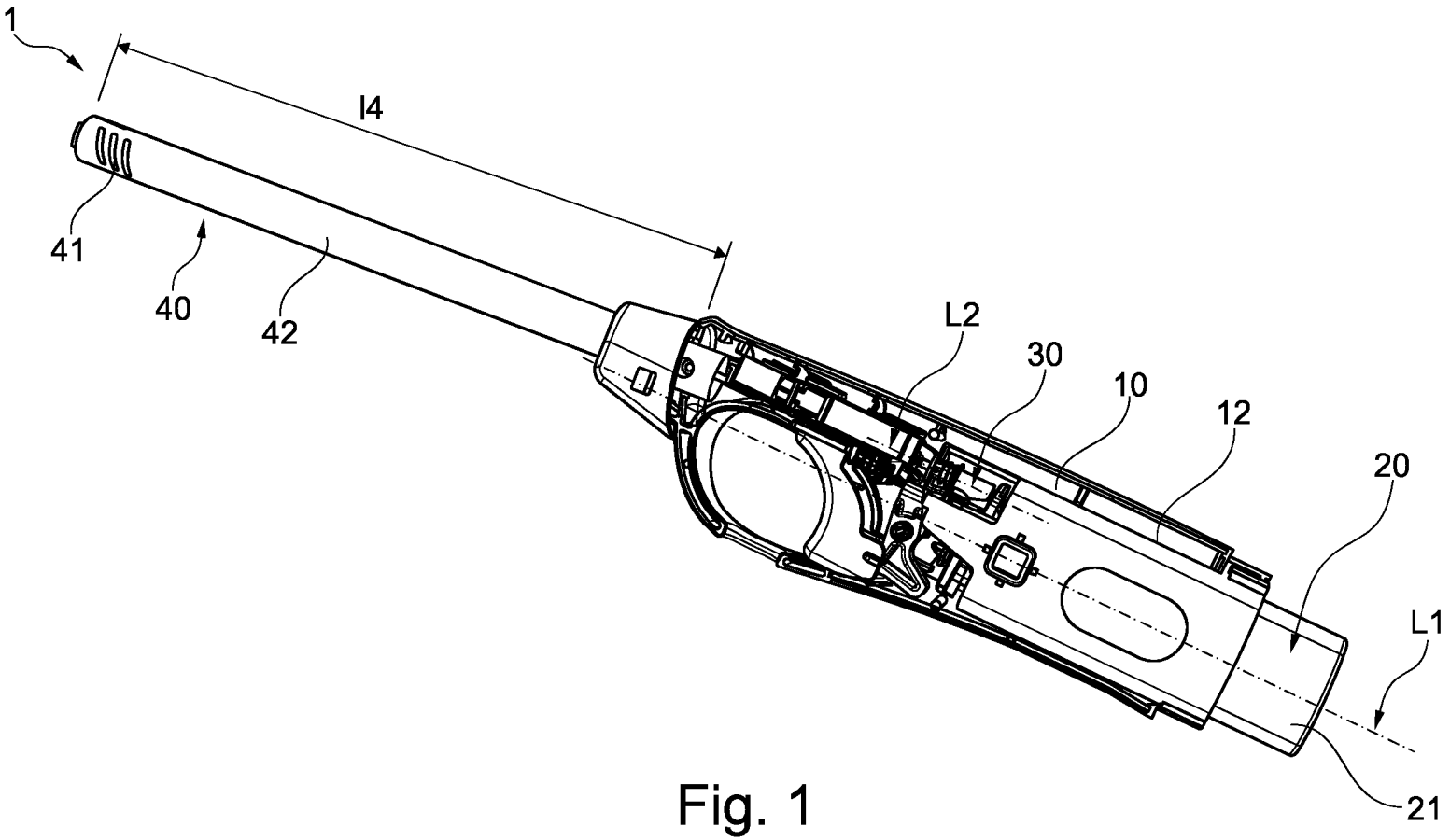
FIG. 1 is a schematic view of a lighter coupled to a gas and/or fuel reservoir device.

FIG. 1 is a schematic view of a lighter 1 according to the present disclosure. The lighter 1 comprises a housing 10 which has a nozzle 40. The housing 10 is adapted to receive a gas and/or fuel reservoir device 20. Furthermore, the lighter 1 comprises a connecting device 30, which is configured to couple the gas and/or fuel reservoir device 20 to the nozzle 40. The connecting device 30 is adjustable, which is described in more detail below. Since the connecting device is adjustable, the lighter can be coupled to variations of gas and/or fuel reservoir devices which might have different geometrical and structural dimensions. As an example, the lighter 1 according to the present disclosure can be selectively coupled to a commercially available pocket lighter or to a non-commercially available gas and/or fuel reservoir. Thus, a lighter can be provided with an easy, safe and inexpensive refill and/or supply of gas and/or fuel. Furthermore, an eco-friendly lighter can be provided because less components have to be disposed of as compared to a non-refillable lighter.

As shown in FIG. 1, the lighter 1 comprises a longitudinal axis L1, which extends in a longitudinal direction of the lighter 1. Thereby, the longitudinal axis L1 can extend through a center of the lighter 1, more specifically through a geometrical center of the housing 10 of the lighter 1. The housing 10 comprises a housing recess 12 which is configured to receive and support the gas and/or fuel reservoir device 20. The housing recess 12 may extend in a longitudinal direction of the housing 10, beginning from one end face of the housing 10, which may be opposite the nozzle 40. In the embodiment shown in FIG. 1, the housing recess 12 extends aligned to the longitudinal axis L1. More specifically, the longitudinal axis L1 extends through the geometrical center of the housing recess 12.

The lighter 1 may further comprise a lid, however not shown in FIG. 1, which may be designed to be coupled to the housing 10. More specifically, the lid may be configured to cover the housing recess 12. In embodiments, the lid may be coupled to the housing 10 by a positively locking connection, more specifically by a snap-fit connection. The lid may be a separate component and the housing may comprise a flange, wherein the lid can be pushed over the housing flange, more specifically along the longitudinal axis L1. Additionally or alternatively, the lid can be connected to the housing 10 via a hinge. Thereby, at least on edge of the lid may be connected by a pin to the housing 10, more specifically to an edge of the housing flange. Thus, the lid can be pivoted towards to the housing 10 in order to cover the housing recess. Furthermore, the lid may comprise a tensioning element which may be configured to apply a preload in the direction of the longitudinal axis L1.

Figures 5A, 5B, 5C:
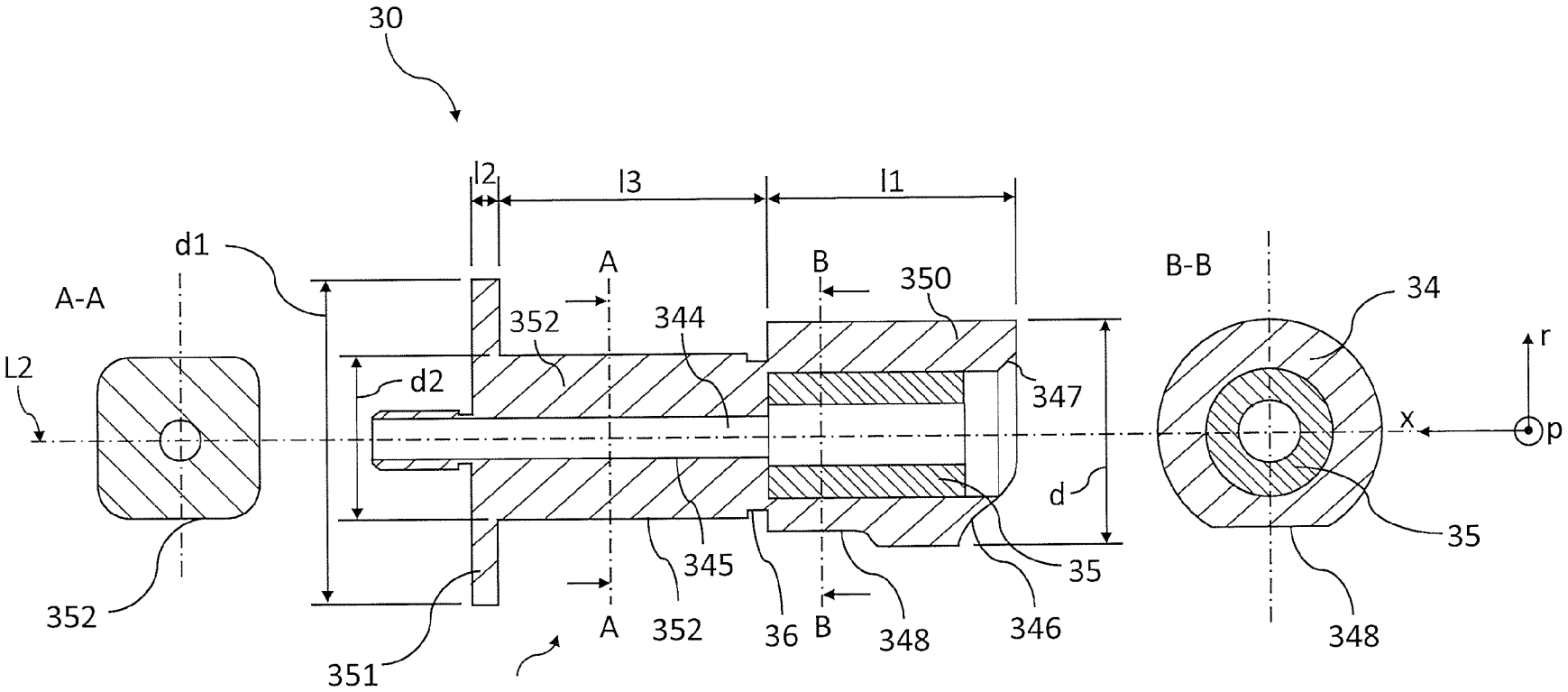
FIGS. 5A to 5C are schematic cutaway side views of a connecting device taken from the embodiment of FIG. 3.

FIGS. 3 and 5A to 5C are schematic views of the adjustable connecting device 30. As shown in FIG. 5B, a coordinate system can be defined for the connecting device 30. The coordinate system comprises a longitudinal direction x of the connecting device 30, a radial direction r of the connecting device 30 which is perpendicular to the longitudinal direction x, and a perpendicular direction p which is perpendicular to the longitudinal direction x and the radial direction r.

Figure 3:
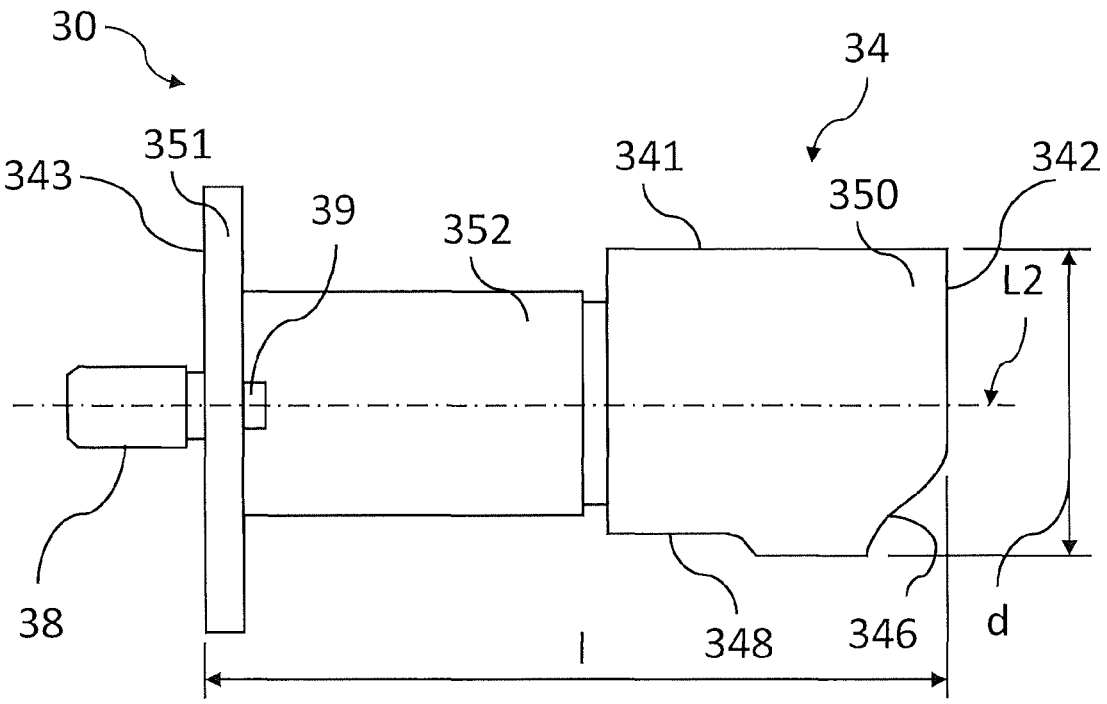
FIG. 3 is a schematic view of a connecting device which is configured to couple the lighter to a gas and/or fuel reservoir device.

As shown in FIGS. 3 and 5B, the connecting device 30 comprises a connecting body 34, wherein the connecting body 34 may be cylindrical. The connecting device 30 comprises a longitudinal axis L2 which extends through the center of the connecting device 30 in the longitudinal direction x of the connecting device 30, more specifically in the longitudinal direction x of the connecting body 34. The connecting body 34 is defined by a length l and a diameter d. Furthermore, the connecting body 34 has an outer circumferential surface 341, a first end face 342 and a second end face 343. As shown in FIG. 5B, the connecting body 34 comprises an opening 344, which defines an inner circumferential surface 345. The opening 344 may extend through the connecting device, more specifically the connecting body 34, from the first end face 342 to the second end face 343. The connecting body 34 comprises a coupling member 38 which can be arranged at the second end face 343. The coupling member may be rigidly connected to the connecting body 34. The coupling member 38 may be configured to couple the connecting device 30 to the nozzle 40. The coupling member 38 may comprise a coupling opening which may be fluidly coupled to the opening 344 of the connecting device 30.

As shown in FIGS. 3 and 5B, the connecting body 34 comprises a chamfer 346 or slope cut. The chamfer 346 is arranged between the first end face 342 and the outer circumferential surface 341. The chamfer 346 may extend at least partially over a circumference of the connecting body 34. The circumference of the connecting body 34 may be defined on the outer circumferential surface 341 with respect to the longitudinal axis L2. The chamfer may extend from the first end face 342 at a position which is less than half the diameter d in an oblique direction toward the outer circumferential surface 341 of half the diameter d. The oblique direction may be defined by the radial direction r with respect to the longitudinal axis L2 and the longitudinal direction x with respect to the longitudinal axis L2. In a plane defined by the radial direction r and the longitudinal direction x, the chamfer 346 may comprise a linear shape and/or a concave shape and/or a convex shape and/or a wave-shape comprising a concave portion and a convex portion. Additionally or alternatively, the chamfer 346 may comprise rounded edges.

In embodiments, the connecting body 34 comprises a bevel 347 arranged between the first end face 342 and the inner circumferential surface 345. The bevel may extend at least partially over the circumference of the inner circumferential surface 345. In embodiments, the bevel extends over the circumference of the inner circumferential surface 345 of the connecting body 34.

As shown in FIGS. 3, 5B and 5C, the connecting body 34 comprises a recess 348 which extends at least partially over the outer circumferential surface 341. More specifically, the recess 348 extends at least partially over the length l of the connecting body 34. Referring to FIG. 5C, the recess 348 may have a planar shape on the outer circumferential surface 341, which may form a plane that is substantially parallel to a plane x-p defined by the longitudinal direction x and the perpendicular direction p.

Figure 2:
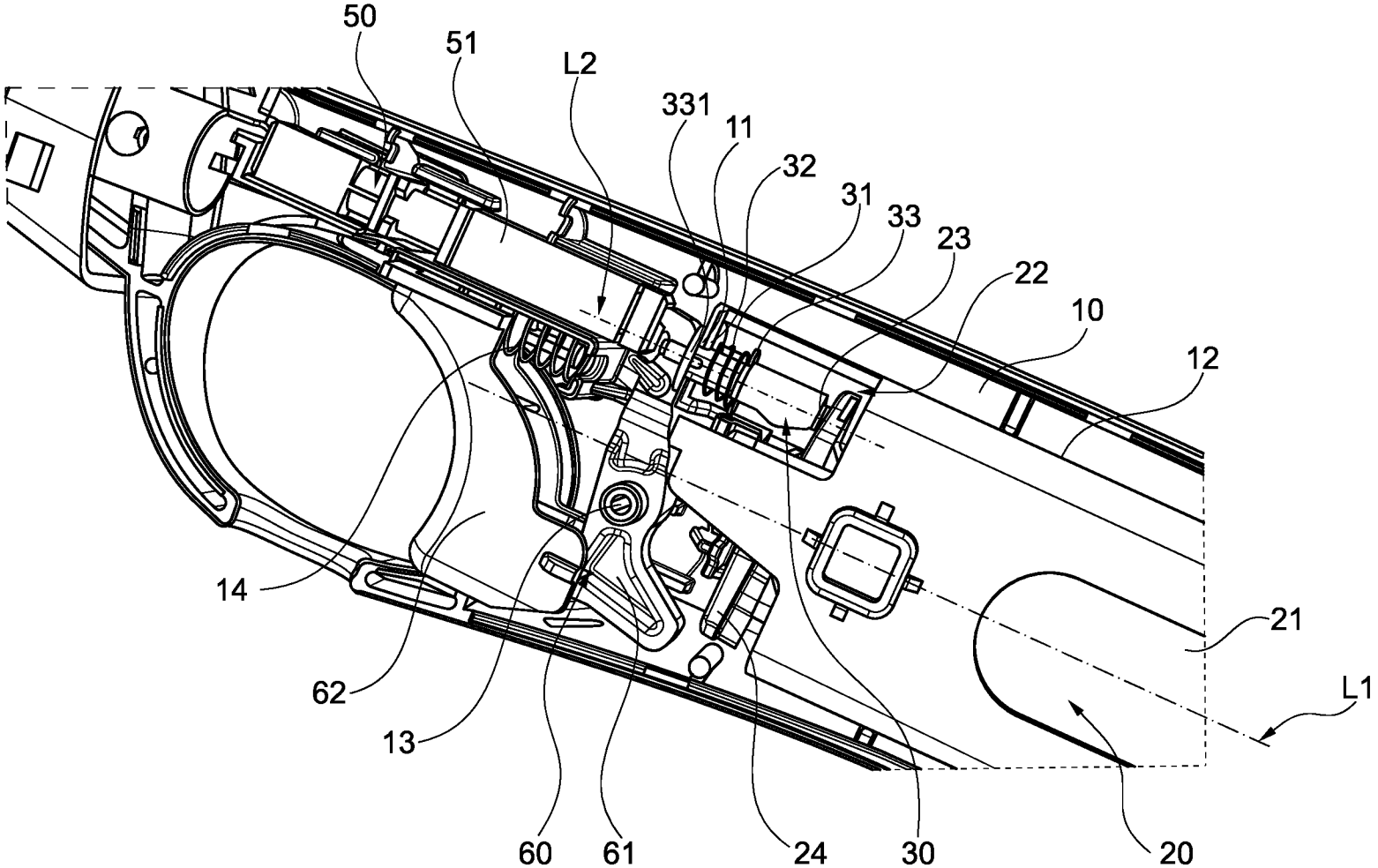
FIG. 2 is a more detailed schematic view of a lighter coupled to a gas and/or fuel reservoir device.

In embodiments, the connecting body 34 may only comprise the chamfer 346 or the recess 348. In case the connecting body 34 comprises both the recess 348 and the chamfer 346, the recess 348 and the chamfer may be substantially aligned to each other on the outer circumferential surface 341, more specifically on a circumferential position of the connecting body 34, with respect to the longitudinal axis L2. Referring to FIG. 2, the longitudinal axis L1 of the lighter 1 and the longitudinal axis L2 of the connecting device 30 may lie in the same plane with respect to the perpendicular direction p. Thus, the recess 348 and the chamfer 346 may be oriented toward the center of the lighter 1, more specifically toward the geometric center of the lighter 1. In other words, the recess 348 and the chamfer 346 may be oriented toward the longitudinal axis L1 of lighter 1. As shown in FIGS. 3 and 5B, when starting from the first end face 342 along the longitudinal axis L2, more specifically in the longitudinal direction x, the connecting body 34 comprises the chamfer 346, followed by a section of diameter d, followed by the recess 348. However, in embodiments, the recess 348 may extend from the first end face 342 at least partially along the connecting body 34 toward the second end face 343. Thus, starting from the first end face 342, the connecting body 34 may comprise the chamfer 346, followed by the recess 348. In embodiments, the chamfer 346 may not be provided at all. Thus, starting from the first end face 342, the connecting body may comprise the recess 348 extending at least partially along the connecting body 34 toward to second end face 343.

As shown in FIGS. 3 and 5B, the connecting body 34 comprises a first portion 350 proximate the first end face 342 having diameter d and a length l1. Furthermore, the connecting body 34 comprises a second portion 351 proximate the second end face 343 having a diameter d1 and a length l2. The diameter d1 of the second portion 351 may be larger than the diameter d of the first portion 350. The second portion 351 may be rigidly connected to the first portion 350. In embodiments, the connecting body 34 further comprises a third portion 352 arranged between the first portion 350 and the second portion 351, wherein the third portion 352 has a diameter d2 and a length l3. In this case, the first portion 350 may be rigidly connected to the third portion 352 and the third portion 352 may be rigidly connected to the second portion 351. The diameter d1 of the second portion 351 may be larger than the diameter d of the first portion 350 and/or the diameter d2 of the third portion 352. More specifically, the diameter d2 of the third portion 352 may be smaller than the diameter d of the first portion 350 and/or the diameter d1 of the second portion 351. In embodiments, the length l2 of the second portion 351 may be less than the length l1 of the first portion 350 and/or the length l3 of the third portion 352. The length l1 of the first portion 350 and/or the length l3 of the third portion 352 may be at least 2 times, in examples at least 4 times, larger than the length l2 of the second portion 351. At least a portion of the connecting body 34 may comprise a square-shaped cross-section, more specifically a square-shaped cross-section with rounded edges. As shown in FIG. 5A, the third portion 352 comprises a square-shaped cross-section with rounded edges.

The opening 344 as described above may have a first opening portion proximate the first end face 342, more specifically in the first portion 350, having a first opening diameter, and a second opening portion proximate the second end face 343, more specifically in the second and third portion 351, 352, having a second opening diameter. The first opening portion and the second opening portion may be fluidly coupled to each other. The first opening diameter may be larger than the second opening diameter.

As shown in FIGS. 5B and 5C, the connecting device 30 further comprises a seal member 35, more specifically a seal bushing. The seal member 35 may be configured to couple to the gas and/or fuel reservoir device 20. The seal member 35 may be arranged in the connecting body 34, more specifically in the opening 344 of the connecting body 34 proximate the first end face 342, in particular in the first opening portion.

Figure 4A:
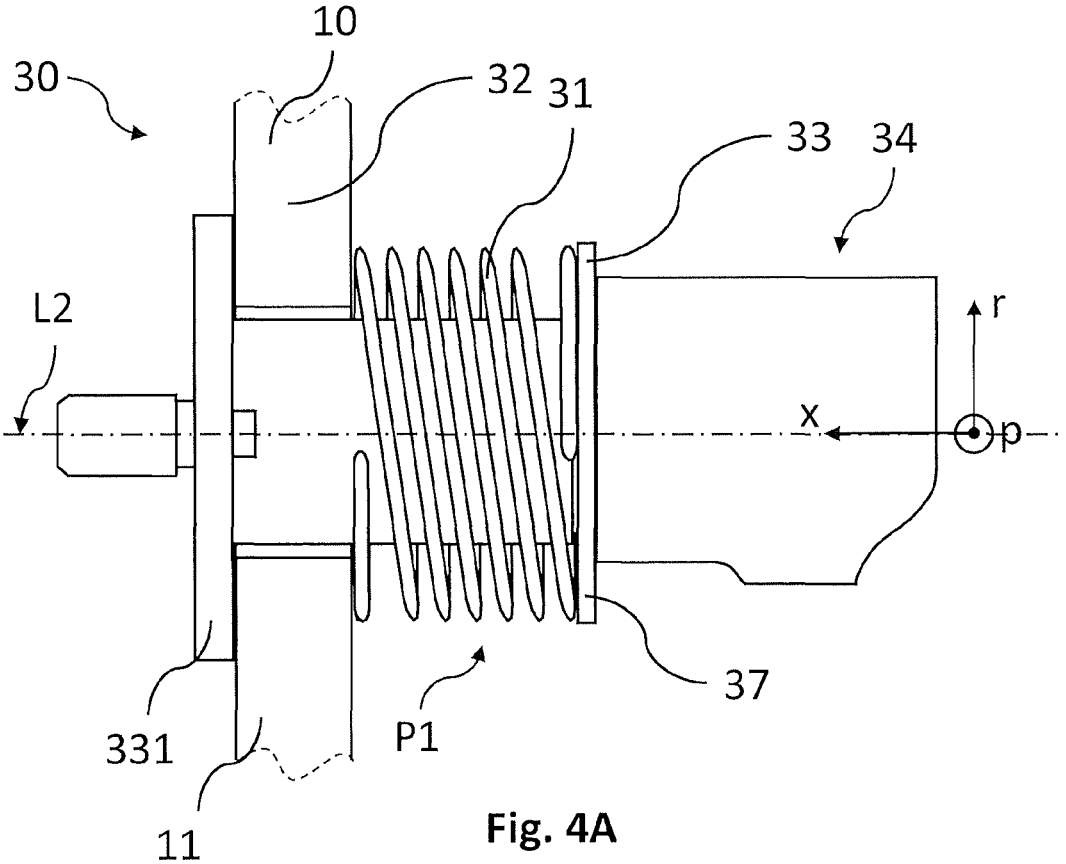
FIG. 4A is a schematic view of the connecting device as shown in FIG. 3, but which is assembled in the housing of the lighter and in a fully extended position.
Figure 4B:
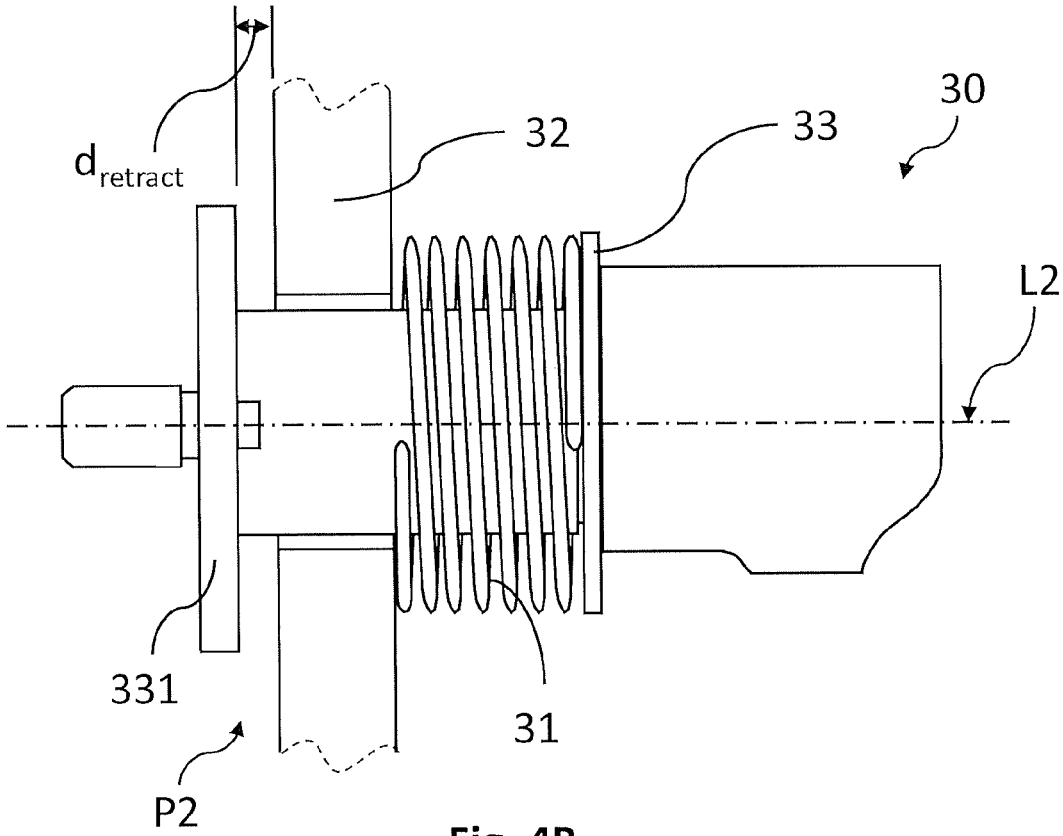
FIGS. 4B and 4C are schematic views of the connecting device shown in FIG. 3 but which are assembled in the housing of the lighter and are in adjusted, retracted positions.
Figure 4C:
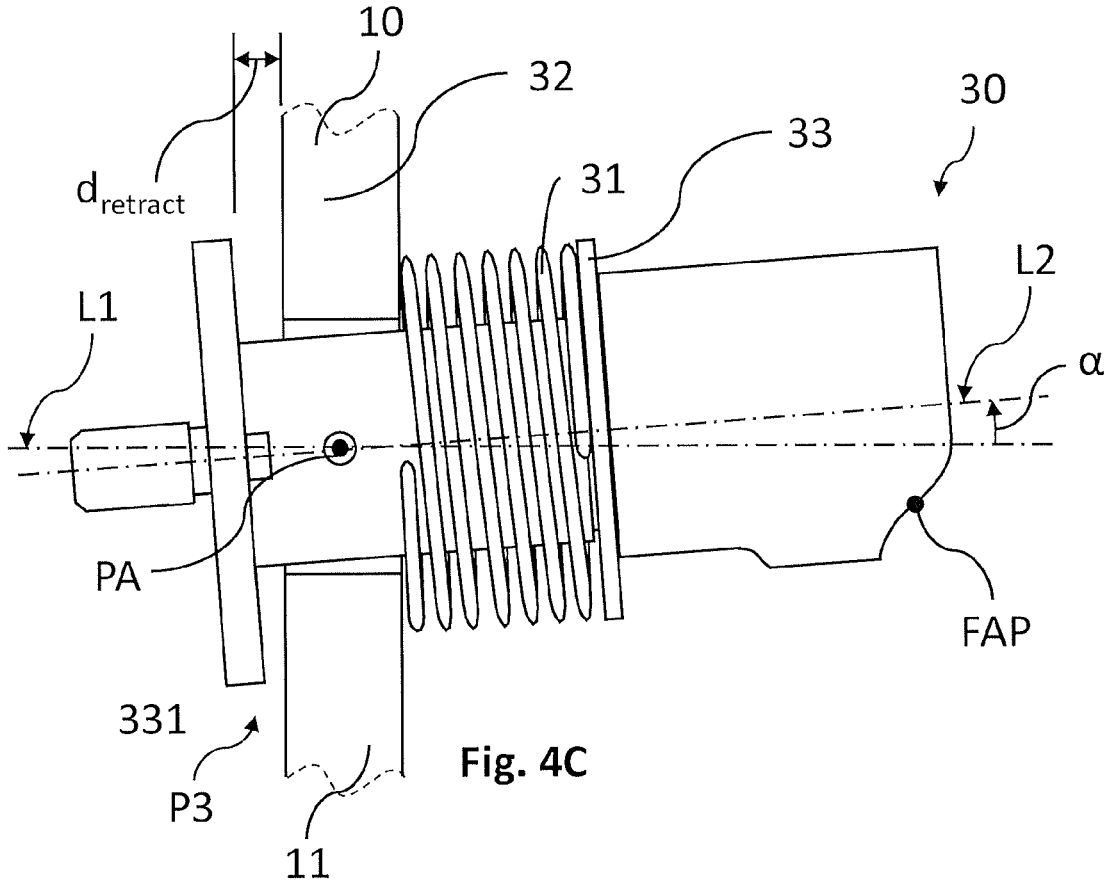

As shown in FIGS. 3 and 5B, the connecting body 34 comprises a groove 36 on the outer circumferential surface 341. The groove 36 may extend at least partially over the circumference of the connecting body 34. In embodiments, the groove 36 may extend over the whole circumference of the connecting body 34. The groove may be formed between first portion 350 and third portion 352. As can be seen in FIGS. 4A to 4C, the connecting device 30 may comprise a retaining ring 37, which can be inserted into the groove 36.

As shown in FIGS. 1, 2 and 4A to 4C, the connecting device 30 is arranged in the housing 10. The housing 10 comprises a support element 11 that is configured to receive and support the connecting device 30. The connecting device 30 may be movably received by the housing 10, more specifically by the support element 11. In embodiments, the support element 11 may support and receive the third portion 352 of the connecting body 34.

Referring to FIGS. 1, 2 and 4A to 4C, the connecting device 30 is adjustable substantially along the longitudinal axis L1. In embodiments, the connecting device 30 is adjustable along the longitudinal axis L1. More specifically, the connecting device 30 can be adjustable by at least 0.5 mm, more specifically by at least 0.7 mm, along the longitudinal axis L1. It should be understood that an adjustment of the connecting device 30 does not mean that the connecting device 30 is actively actuated by another component, e.g. actively actuated by an actuator which may adjust the position of the connecting device 30 due to any input, e.g. like a force and/or a control signal. Rather, it means that the connecting device 30 is configured to move when another component transmits a force to the connecting device 30 which will be described more detailed below. However, it should be understood that active actuation of the connecting device 30 may not be excluded in the present disclosure.

FIGS. 4A to 4C are schematic views of the adjustable connecting device 30. The connecting device 30 is adjustable between a fully extended position P1 and a fully retracted position. The fully extended position P1 of the connecting device is shown, for example, in FIG. 4A. A retracted position P2 is present, when, starting from the fully extended position P1, the connecting device 30 is adjusted and/or moved along the longitudinal axis L1 relative to the housing 10, more specifically relative to the support element 11 (see, e.g., FIG. 4B or 8A). The fully retracted position is reached, when the connecting device 30 is adjusted along the longitudinal axis L1 relative to the support element 11 as far as possible depending on geometric conditions, more specifically stops, that are described in detail below. In embodiments, the distance between the fully extended position P1 and the fully retracted position may be in the range of 0.5 to 15 mm, more specifically in the range of 0.7 to 10 mm, in particular in the range of 0.8 to 8 mm.

As shown in FIGS. 1, 2 and 4A to 4C, the connecting device 30 comprises a biasing element 31, wherein the biasing element 31 biases the connecting device 30 in the direction of the longitudinal axis L1 of the lighter 1, more specifically along the longitudinal axis L2 opposite the longitudinal direction x. The biasing element 31 may be a compression spring, more specifically a coil spring. When the connecting device 30 is not adjusted, as shown in FIG. 4A, the biasing element 31 biases the connecting device 30 to maintain in the fully extended position P1. In the fully extended position P1, the longitudinal axis L2 of the connecting device 30 may be substantially parallel to the longitudinal axis L1 of the lighter 1. In the fully extended position P1, the biasing element 31 may have a biasing force of at least 40%, more specifically of at least 50%, in particular of at least 60%, compared to the biasing force in the fully retracted position.

As shown in FIG. 4C, the connecting device 30 is not only adjustable along the longitudinal axis L1, but is also adjustable transverse to the longitudinal axis L1 of the lighter 1. More specifically, the connecting device 30 may be pivotable. "Transverse" refers to a direction which is perpendicular to the longitudinal axis L1 in a plane defined by longitudinal axis L1 and transverse direction when the lighter 1 is viewed from a side view, e.g. as shown in FIGS. 1 and 2. More specifically, the connecting device 30 may be pivotable about an imaginary pivot axis PA which is perpendicular to the plane defined by longitudinal axis L1 and the transverse direction. The connecting device 30 may be pivoted substantially about the structure of the support element 11 that supports the connecting device 30, more specifically substantially about the imaginary pivot axis PA of the support element 11, shown in FIG. 4C. However, it should be noted that the imaginary pivot axis PA may change its position depending on forces acting on the connecting device 30 and respective force application points FAP. Such a force application point FAP is shown in FIG. 4C.

The connecting device is adjustable in the transverse direction, since the gas and/or fuel reservoir device 20, which may be coupled to the lighter, can have structural components wherein a direct access of the connecting device 30 to couple to the gas and/or fuel reservoir device 20 may not be possible. Since the connecting device 30 is adjustable along the longitudinal axis L1 and/or transverse to the longitudinal axis L1, the connecting device 30 may compensate for geometrical differences and/or may move around any structural components of the gas and/or fuel reservoir device 20 to couple to the latter.

Referring to FIG. 4C, the connecting device 30 may be adjustable by an angle $\alpha$ of at least 5°, more specifically by at least 7°, in particular by at least 10°, measured between the longitudinal axis L1 of the lighter 1 and a longitudinal axis L2 of the connecting device 30. It is to be noted that in FIG. 4C, the longitudinal axis L1 has been moved parallel from the center of the lighter 1 as described above toward the connecting device 30, in order to simplify a visualization of the angle $\alpha$. Angle $\alpha$ may be present when the connecting device 30 is adjusted in the transverse direction, in other words when the connecting device 30 is pivoted.

In embodiments, wherein, when starting from the first end face 342 of the connecting body 34 the chamfer 346 is provided followed by the recess 348, or only the recess 348 is provided, it may be sufficient that the connecting device 30 is only adjusted along the longitudinal axis L1, but not in the transverse direction.

As shown in FIGS. 2 and 4A to 4C, the connecting device 30 comprises a first stop 33 and the housing 10 comprises a second stop 32. The biasing element 31 is arranged between the first stop 33 and the second stop 32. The biasing element 31 may surround the outer circumferential surface 341 of the connecting body 34. More specifically, the biasing element 31 may surround the third portion 352. In embodiments, the first stop 33 is formed by the retaining ring 37, when the retaining ring 37 is inserted into the groove 36. However, in an embodiment, instead of providing the groove 36 and the retaining ring 37, the first stop 33 may be formed by a side wall of the first portion 350, which may be provided when the diameter d of the first portion is larger than the diameter d2 of the third portion 352. Alternatively, the first stop 33 may be formed a fourth portion, which may be arranged between third portion 352 and first portion 350, and which may have a diameter that is larger than the diameter d2 of the third portion 352. The fourth portion may be rigidly connected to the first portion 350 and the third portion 352. As shown in FIGS. 2 and 4A to 4C, the second stop 32 is formed by the support element 11, more specifically by at least a portion of a side wall of the support element 11 facing the first stop 33. The connecting device 30 further comprises a third stop 331, more specifically wherein the third stop 331 is formed by the second portion 351.

As shown in FIG. 4A, in the fully extended position P1, the third stop 331 contacts the second stop 32. More specifically, the third stop 331 may contact at least a portion of a side wall of the support element 11 facing the third stop 331. In other words, in the fully extended position P1, the second portion 351 (or third stop 331) contacts the support element 11 on a first side wall of the support element 11. In this embodiment, the biasing element 31 is arranged between a second side wall of the support element 11, opposite the first side wall, and the first stop 33. The first side wall of the support element 11 may face toward the nozzle 40 of the lighter 1 and the second side wall of the support element 11 may face toward the housing recess 12 of the lighter 1.

As shown in FIG. 4B, in a retracted position P2 which is between the fully extended position P1 and the fully retracted position, and/or in the fully retracted position of the connecting device 30, a distance $d_{retract}$ can be defined between the second stop 32 and the third stop 331. The distance $d_{retract}$ may refer to the respective distances in mm as described above.

FIG. 4C shows an adjusted, retracted position P3 of the connecting device 30 wherein the connecting device 30 is adjusted along the longitudinal axis L1 and transverse to the longitudinal axis L1, thus forming the angle α. Such a retracted position P3 occurs when a force is applied on the connecting device 30, more specifically wherein the force can be applied on the chamfer 346 shown by force application point FAP. Thereby, the force is obliquely applied on the connecting device 30, having not only a force component in the direction of the longitudinal axis L1, but also in the transverse direction with respect to the longitudinal axis L1. The angle α as described above is formed due to the application of the oblique force. Since the biasing element 31 can be a compression spring, more specifically a coil spring, the biasing force of the biasing element 31 may increase on a side of the connecting device 30, to which the connecting device 30 is adjusted and/or pivoted. When the force is released from the connecting device 30, the increased biasing force may push the connecting device 30 back to the fully extended position P1, wherein the angle α may be about 0° and/or wherein the distance $d_{retract}$ may be about 0.0 mm.

As described above, the support element 11 is configured to support and receive the connecting device 30, more specifically wherein the connecting device 30 can be adjustably and/or movably received by the support element 11. Referring to FIGS. 3 and 4A to 4C, the support element 11 and/or the connecting device 30 may be adapted to prevent rotation of the connecting device 30 about its longitudinal axis L2 when received by the support element 11. In a first embodiment, rotation of the connecting device 30 may be prevented by the square-shaped cross-section of the connecting body 34, more specifically the third portion 352, and an associated shape of the support element 11 that allows adjustment of the connecting device 30 but prevents rotation about longitudinal axis L2. Additionally or alternatively, the connecting body 34 may comprise an anti-rotation element 39 on the outer circumferential surface 341, wherein the anti-rotation element 39 may protrude in a radial direction of the connecting body 34 from the outer circumferential surface 341. The support element 11 may be provided with an associated recess with which the anti-rotation element 39 may engage to prevent rotation. In embodiments, the connecting body 34 may comprise a cut-out and the support element 11 may comprise at least one pin protruding into the cut-out, wherein the connection of pin and cut-out may allow adjustment of the connecting device 30 but may prevent rotation about the longitudinal axis L2.

Referring to FIG. 1, the nozzle 40 comprises a nozzle outlet 41 and may comprise a conduit, more specifically wherein the conduit may be fluidly coupled to the connecting device 30, in particular to the coupling member 38 of the connecting device 30. The nozzle 40 comprises a tubular body 42 and the conduit may be at least partially arranged in the tubular body 42. The tubular body 42 may be rigidly connected to the connecting device 30. The tubular body 42 may have a length l4 of at least 3 cm, more specifically of at least 7 cm, in particular of at least 10 cm. In embodiments, the tubular body 42 may have a length l4 in the range of about 3 cm to about 25 cm, more specifically in the range of about 7 cm to about 20 cm, in particular in the range of about 10 cm to about 17 cm.

Figure 7:
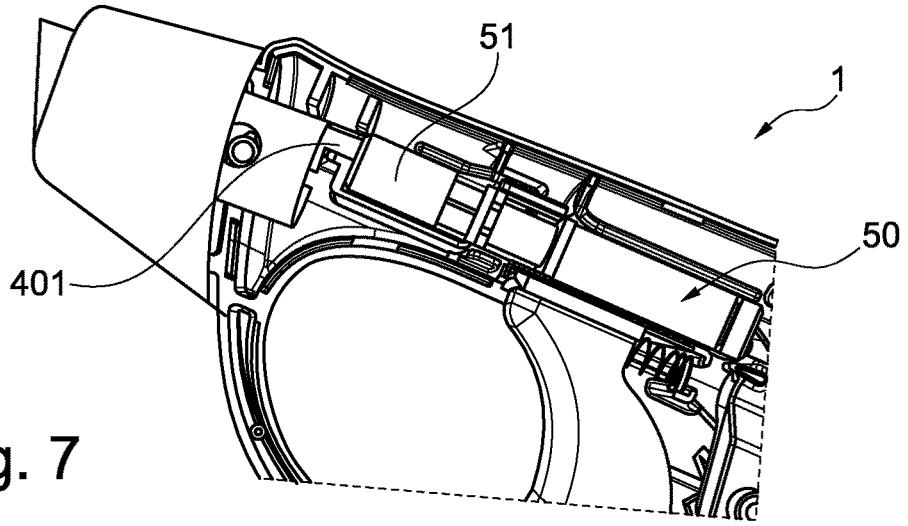
FIG. 7 is a more detailed schematic view of the igniter assembly of the lighter.

Referring to FIGS. 1 and 2, the lighter 1 comprises an igniter assembly 50 operatively connected to the housing 10 for generating a spark at the nozzle 40, more specifically at the nozzle outlet 41. The igniter assembly 50 comprises a piezoelectric mechanism 51, which is adapted to provide electrical voltage due to an application of force on solids. The housing 10 may comprise an electrically conductive component which may be electrically coupled to the piezoelectric mechanism 51. The electrically conductive component may be arranged between the nozzle 40, more specifically the nozzle outlet 41, and the piezoelectric mechanism 51 to form an electrode. Referring to FIG. 7 the nozzle 40 may include at least a protruding portion 401 with electrically conductive material which is electrically coupled to the piezoelectric mechanism 51. Thus, when the piezoelectric mechanism 51 is actuated, a spark is formed between the nozzle 40 comprising an electrically conductive material and the electrically conductive component, more specifically wherein the spark is formed at the nozzle outlet 41. In embodiments, the electrically conductive component may include a tab extending toward the nozzle 40, more specifically toward the nozzle outlet 41, wherein the spark may be formed between the tab and the nozzle 40. The lighter 1 may comprise an electrically insulating component disposed around at least a portion of the nozzle 40 for preventing undesired sparks between the nozzle 40 and the electrically conductive component.

As shown in FIGS. 1 and 2, the lighter 1 comprises an actuating assembly 60 operatively coupled to the housing 10 and configured to operatively activate the igniter assembly 50. The actuating assembly 60 comprises a linkage arm 61 which may be operatively coupled to the igniter assembly 50 for activating the igniter assembly 50. The linkage arm 61 may, when actuated, compress the piezoelectric mechanism 51 which in turn will generate a spark at the nozzle 40, more specifically at the nozzle outlet 41. In embodiments, a pin 13 is rigidly connected to the housing 10, wherein the linkage arm 61 may be coupled to the pin 13. More specifically, the linkage arm 61 may be pivotably coupled to the pin 13. The actuating assembly 60 further comprises a trigger member 62 operatively coupled to the linkage arm 61 and to the housing 10. The trigger member 62 may be adapted to be actuated by a user. The igniter assembly 50 may be activated by the linkage arm 61 when a user actuates the trigger member 62. The trigger member 62 may extend from the housing 10 and may be movable from a first, unactuated position to a second, actuated position. Referring to FIG. 2, a biasing member 14 is arranged between housing 10 and actuating assembly 60, more specifically between housing 10 and trigger member 62, which may be configured to urge the trigger member 62 and/or the linkage arm 61 to the first, unactuated position in case the trigger member 62 is not actuated by a user.

In embodiments, however not shown in the figures, the housing 10 may further comprise a locking element operatively coupled to the actuating assembly 60. The locking element may be movable between a first locking element position and a second locking element position. In the first locking element position, the locking element may prevent operative movement of the actuating assembly 60 and in the second locking element position, the locking element may permit operative movement of the actuating assembly 60. The locking element may be provided in order to increase the safety of the lighter, e.g. to make the lighter child resistant. In the first locking element position, a movement of the actuating assembly 60, more specifically of the trigger member 62 may be prevented such that the igniter assembly 50 cannot be actuated. In other words, in the first locking element position, the locking element may prevent operative movement of the trigger member 62 even when a force is applied by a user on the trigger member 62. In embodiments, the locking element may be configured to be automatically moved to the first locking element position when not actuated by a user. The locking element may be provided as a switch operatively coupled to the housing. The switch may be movable from the first locking element position to the second element position. Additionally or alternatively, the safety of the lighter 1 may be increased by an adaption of the force required to activate the lighter 1, e.g. via the biasing element 14 and/or by the actuating assembly 60 shown in FIG. 2. The biasing element may be configured to urge the trigger member 62 to the first, unactuated position. In order to actuate the lighter 1, a user may have to apply a force on the trigger member 62 that is larger than the spring force provided by the biasing element 14 and/or that is large enough to actuate the actuating assembly 60, e.g. for activating the igniter assembly 50 and/or the gas and/or fuel reservoir device 20. In embodiments, the biasing element 14 may be adapted to provide a spring force sufficiently large and/or the actuating assembly 60 may be configured to require an actuation force large enough to provide a child safety lock for the lighter 1, thus increasing safety of the lighter 1.

According to a second aspect of the present disclosure, a lighter 1 comprises the gas and/or fuel reservoir device 20 coupled to the lighter 1, as shown in FIGS. 1 and 2. The lighter 1 can be provided with any of the embodiments as described for the first aspect of the present disclosure. The gas and/or fuel reservoir device 20 is configured to be replaceably coupled to the lighter 1. The gas and/or fuel reservoir device 20 is configured to be inserted into the housing 10. More specifically, the gas and/or fuel reservoir device 20 is configured to be inserted into the housing recess 12.

The gas and/or fuel reservoir device 20 is now described in more detail. FIGS. 6A and 6C are exploded views of two different embodiments of the gas and/or fuel reservoir device 20, which can be coupled to the lighter 1, respectively. As shown in FIGS. 6A and 6C, the gas and/or fuel reservoir device 20 comprises a fluid reservoir 21 and a valve assembly 22 for selectively dispensing gas and/or fuel. The fluid reservoir 21 can be filled with gas and/or fuel and may be refilled when empty. In an embodiment, the gas and/or fuel in the fluid reservoir 21 can be liquid and can become gaseous when exiting the fluid reservoir 21. The fuel and/or gas may be isobutane blend hydrocarbon comprising a density at 23° C. of at least 0.553 g/cm$^3$ and vapor pressure at 55° C. up to 679 kPa. The fluid reservoir 21 can be made of plastic, more specifically polyacetal, in particular Delrin. The fluid reservoir 21 comprises a base 212 that is connected to the fluid reservoir 21 on one side of the fluid reservoir. The base 212 may comprise an opening extending through the base 212 such that the fluid reservoir 21 can be filled with fuel and/or gas through the opening. The fluid reservoir 21 may comprise a ball 213 provided in the opening which, together with the structure of the base 212, may act as a non-return valve which prevents fluid from leaking out of the fluid reservoir 21 through the base 212. On a side of the fluid reservoir 21 opposite the base 212, the fluid reservoir comprises at least one protrusion 211, more specifically two protrusions 211, which may be separated from each other and which extend in a longitudinal direction of the fluid reservoir 21.

The valve assembly 22 comprises an adjustable valve 23 and a valve actuator 24, wherein the valve actuator 24 is operatively coupled to the valve 23 for opening and closing the valve 23. The protrusions 211 are configured to pivotally support the valve actuator 24. The adjustable valve 23 comprises a movable valve member 231 and a valve seat 232, which is configured to movably receive the valve member 231. The valve seat 232 is rigidly connected to the fluid reservoir 21. The movable valve member 231 is operatively coupled to the valve actuator 24 for opening and closing the valve 23. Alternatively, the valve assembly 22 may comprise a non-adjustable valve.

The gas and/or fuel reservoir device 20 comprises a spring element 25 coupled to the valve actuator 24, wherein the spring element 25 may urge the valve actuator 24 to an unactuated position wherein the valve 23 is closed. In this case, the valve member 231 is pushed against the valve seat 232, wherein the gas and/or fuel reservoir 20 is prevented from dispensing gas and/or fuel. With respect to FIG. 6B, the valve 23 may further comprise a rubber gasket 233 connected to the valve member 231 such that a fluid-tight connection between valve member 231 and valve seat 232 can be provided when the valve 23 remains unactuated. The valve 23 further comprises a membrane 234 for regulating fluid flow, which may be connected to the valve seat 232, and a disk 235 for sealing the membrane 232 in the valve seat 232. The valve assembly 22 may further comprise a hood 28 coupled to the fluid reservoir 21 and covering at least one or more of the components as described above.

Referring to the embodiment of the gas and/or fuel reservoir device 20 shown in FIGS. 6C and 6D, the gas and/or fuel reservoir device 20 is configured to be independently used as a lighter, e.g. as a pocket lighter such as the BIC Maxi J26. In the embodiment of the gas and/or fuel reservoir device 20 shown in FIGS. 6C and 6D, the gas and/or fuel reservoir device 20 comprises an ignition device 26 for generating a spark at the valve assembly 22, more specifically at the valve 23. The ignition device 26 comprises a spark wheel 261 coupled to the gas and/or fuel reservoir device 20 and a flint 262 coupled to the gas and/or fuel reservoir device 20, wherein the flint 262 is operatively coupled to the spark wheel 261 to generate a spark upon rotation of the spark wheel 261. The valve actuator 24 may be operatively coupled to the ignition device 26. Alternatively, the ignition device 26 may comprise a piezoelectric component which may be configured to generate a spark at the valve 23 upon activation by the valve actuator 24. The gas and/or fuel reservoir device 20 may comprise a spring member 264, that urges the flint 262 toward the spark wheel 261. The ignition device 26 comprises a guard member 263 which may be adapted to prevent rotation of the spark wheel 261 in the absence of a pushing force by a user toward the spark wheel 261. Additionally, the guard member 263 may be adapted to allow rotation of the spark wheel 261 in the presence of a pushing force by a user toward the spark wheel 261. The guard member 263 comprises a nose 265 which protrudes towards the valve 23, more specifically towards the movable valve member 231.

The connecting device 30 is configured to be coupled to the valve assembly 22, more specifically to the adjustable valve 23, in a fluid-tight manner. When coupled, the connecting device 30, more specifically the connecting body 34, receives the valve 23, more specifically the movable valve member 231, in the opening 344 proximate the first end face 342. The fluid-tight connection can be provided by the seal member 35 configured to receive the valve member 231.

The actuating assembly 60 as described above and coupled to the housing 10 is further configured to operatively actuate the gas and/or fuel reservoir device 20 for dispensing the gas and/or fuel, more specifically to operatively actuate the valve actuator 24. Referring to FIG. 2, the linkage arm 61 is configured to be operatively coupled to the igniter assembly 50 for activating the igniter assembly 50 and/or is configured to be operatively coupled to the gas and/or fuel reservoir device 20 for dispensing gas and/or fuel. More specifically, the valve assembly 22, in particular the valve actuator 24, may be configured to be actuated by the linkage arm 61 when a user actuates the trigger member 62. When actuated, the valve member 231 is moved by the valve actuator 24 in the direction of the longitudinal axis L1. The movement of the valve member 231 to open the valve 23 for dispensing gas and/or fuel may be either compensated by a movement of the valve member 231 in the opening 344 of the connecting device 30 relative to the connecting device 30, and/or by a movement of the valve member 231 and the connecting device 30 relative to the housing 10, more specifically relative to the support element 11 due to an adjustment of the connecting device 30.

In embodiments, the second, actuated position of the actuating assembly 60 may comprise a first actuation step and a second actuation step subsequent to the first actuation step. In the first actuation step, the linkage arm 61 may be configured to actuate only the valve assembly 22. In the second actuation step, the linkage arm 61 may be configured to actuate the valve assembly 22 and to activate the igniter assembly 50. These features can ensure that gas and/or fuel is already available at the nozzle outlet 41 when a spark is generated.

Figure 8A:
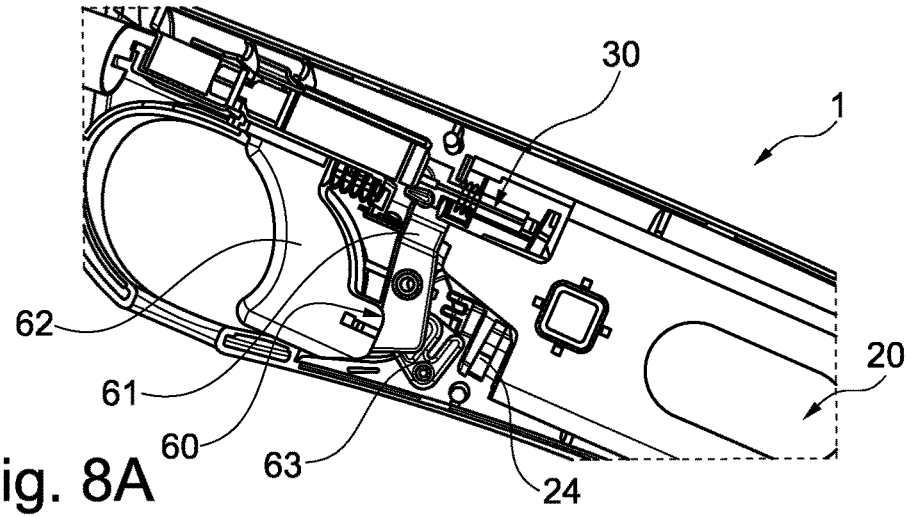
FIGS. 8A and 8B are schematic views of the lighter comprising an actuating assembly with an intermediate pivoting turn rod.
Figure 8B:
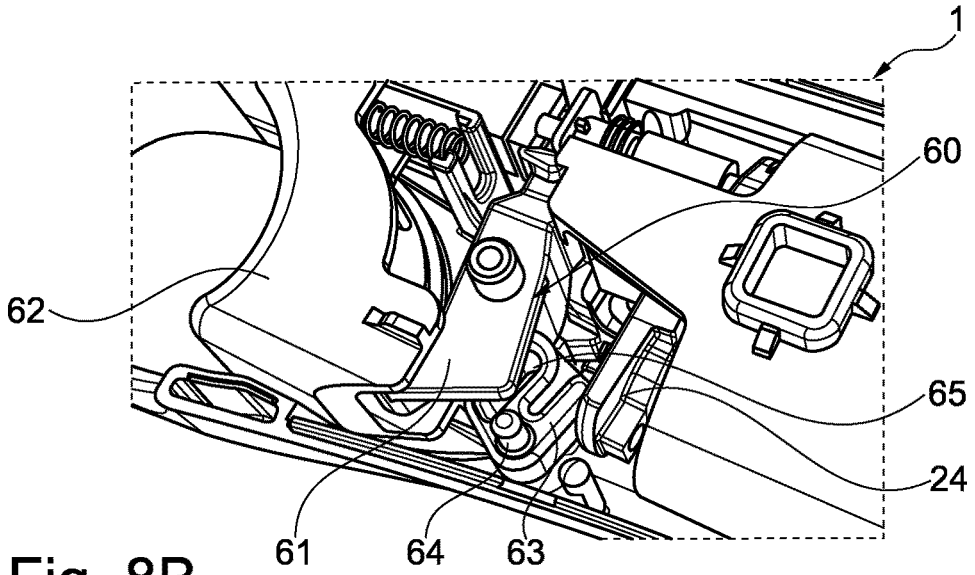

In embodiments, as shown in the schematic views of the lighter 1 in FIGS. 8A and 8B, the actuating assembly 60 comprises an intermediate pivoting turn rod 63 coupled to the housing 10, more specifically wherein the intermediate pivoting turn rod 63 is pivotally coupled to the housing 10 by a turn rod pin 64. The turn rod 63 is arranged between the linkage arm 61 and the gas and/or fuel reservoir device 20. More specifically, the turn rod 63 is operatively coupled to the linkage arm 61 and the valve actuator 24. The turn rod 63 may comprise a turn rod opening 65 configured to receive and slidingly support a projection of the linkage arm 61, e.g. as shown in FIG. 8B. In the first actuation step, the linkage arm 61 may be configured to actuate the valve assembly 22 via the turn rod 63 in order to anticipate the opening of the valve 23 for a better and stabilized lighting efficiency of the lighter 1.

Referring to FIGS. 1 and 2, the gas and/or fuel reservoir device 20 is coupled to the connecting device 30 and is thus fluidly coupled to the nozzle 40 via the connecting device 30. More detailed, when the gas and/or fuel reservoir device 20 is actuated thus dispensing gas and/or fuel, the gas and/or fuel is dispensed from the fluid reservoir 21 through the valve seat 232 and flows into an opening of the valve member 231. The valve 23, more specifically the valve member 231, and the connecting device 30 are fluidly coupled such that the gas and/or fuel can flow via the connecting device 30 and the conduit to the nozzle 40, more specifically to the nozzle outlet 41.

Due to the features described above, there may be geometrical differences between the embodiment of the gas and/or fuel reservoir device 20 as shown in FIG. 6A (which will be referred to in the following as a first gas and/or fuel reservoir device) compared to the embodiment of the gas and/or fuel reservoir device 20 as shown in FIG. 6C (which will be referred to in the following as a second gas and/or fuel reservoir device). First and second gas and/or fuel reservoir devices may have a different height, more specifically wherein the height may be measured between the base 212 and the valve 23. The difference in height may be at least 0.3 mm, more specifically at least 0.5 mm, in particular at least 0.7 mm. However, the difference in height between first and second gas and/or fuel reservoir devices can be compensated by the connecting device 30 being adjustable along the longitudinal axis L1, e.g. as shown in FIG. 8A.

Furthermore, the geometric structure of the first gas and/or fuel reservoir device may allow a direct access of the connecting device 30 to couple to the first gas and/or fuel reservoir device. However, since the second gas and/or fuel reservoir device comprises a guard member 263 having a nose 265 protruding towards the valve 23, a direct access of the connecting device 30 to couple to the second gas and/or fuel reservoir device may not be possible. However, since the connecting device 30 is adjustable in a transverse direction (and/or pivotable), the connecting device 30 may get around the nose 265 and couple to the second gas and/or fuel reservoir device.

Referring to FIGS. 1 and 2, the coupling of the gas and/or fuel reservoir device 20 to the lighter 1 will now be described in more detail. A user detaches the lid from the housing 10 such that the housing recess 12 is opened to receive and support the gas and/or fuel reservoir device 20. Then a user pushes the gas and/or fuel reservoir device 20 into the housing recess 12 along the longitudinal axis L1 and with the valve assembly 22 oriented towards the nozzle, more specifically toward the connecting device 30. The gas and/or fuel reservoir device 20 contacts the connecting device 30 such that the connecting device 30 can be coupled to the valve assembly 22, more specifically to the valve 23, in a fluid-tight manner. During coupling and depending on the geometric structure of the gas and/or fuel reservoir device 20 as described above, the connecting device 30 may be adjusted along the longitudinal axis L1 and/or in the transverse direction.

If a direct access of the connecting device 30 to the valve 23 with respect to the longitudinal axis L1 is possible, the connecting device 30 may only be adjusted along the longitudinal axis L1. If a direct access of the connecting device 30 to the valve 23 with respect to the longitudinal axis L1 is not possible, the connecting device 30 may be adjusted in the transverse direction and/or is pivoted to get around the geometric structure. In case the gas and/or fuel reservoir device 20 comprises the nose 265 protruding to the valve 23, the nose 265 may contact the connecting body 34, more specifically the chamfer 346, at force application point FAP as shown in FIG. 4C. The connecting device 30 pivots and the shape of the chamfer 346 assists the connecting body 34 to slide around the nose 265 when the gas and/or fuel reservoir device 20 is pushed towards the connecting device 30. Subsequently, the nose 265 reaches the recess 348 such that the connecting device 30 can be pivoted back to a position wherein the angle α approaches 0° and/or wherein the longitudinal axis L2 is substantially parallel to longitudinal L1. Finally, the connecting device 30 has access to the valve 23 and can be coupled to the valve 23.

The user attaches the lid to the housing 10 which in turn holds the gas and/or fuel reservoir device 20 in the coupled position. More specifically, the tensioning element of the lid may urge the gas and/or fuel reservoir device 20 along the longitudinal axis L1 toward the connecting device 30. The tensioning element may be adapted to compensate for a difference in height of varying gas and/or fuel reservoir devices 20 in the housing recess 12. Although the above coupling is described for the nose 265, it should be understood that the connecting device 30 may be configured to get around any other structural component of the gas and/or fuel reservoir device 20 that may prevent direct access of the connecting device 30 to the valve 23.

Although the present invention has been described above and is defined in the attached claims, it should be understood that the invention may alternatively be defined in accordance with the following embodiments:

1. A lighter (1), comprising:
   - a housing (10) having a nozzle (40), wherein the housing (10) is adapted to receive a gas and/or fuel reservoir device (20); and
   - a connecting device (30), wherein the connecting device (30) is configured to couple the gas and/or fuel reservoir device (20) to the nozzle (40);

characterized in that the connecting device (30) is adjustable.
2. The lighter (1) according to embodiment 1, wherein the lighter (1) has a longitudinal axis (L1), wherein the connecting device (30) is adjustable along the longitudinal axis (L1).
3. The lighter (1) according to one of the preceding embodiments, wherein the connecting device (30) is adjustable by at least 0.5 mm, more specifically by at least 0.7 mm, along the longitudinal axis (L1).
4. The lighter (1) according to one of the preceding embodiments, wherein the connecting device (30) is adjustable between a fully extended position (P1) and a fully retracted position.
5. The lighter (1) according to embodiment 4, wherein the distance between the fully extended position (P1) and the fully retracted position is in the range of 0.5 to 15 mm, in particular in the range of 0.7 to 10 mm, more specifically in the range of 0.8 to 8 mm.
6. The lighter (1) according to one of the preceding embodiments, wherein the connecting device (30) comprises a biasing element (31), more specifically a compression spring.
7. The lighter (1) according to embodiment 6, wherein the biasing element (31) biases the connecting device (30) in the direction of the longitudinal axis (L1).
8. The lighter (1) according to embodiment 6 or embodiment 7, wherein in the fully extended position (P1), the biasing element (31) has a biasing force of at least 40%, more specifically of at least 50%, in particular of at least 60%, compared to the biasing force in the fully retracted position.
9. The lighter (1) according to one of the preceding embodiments, wherein the connecting device (30) is adjustable transverse to the longitudinal axis (L1), more specifically wherein the connecting device (30) is pivotable.
10. The lighter (1) according to embodiment 9, wherein the connecting device (30) is adjustable by an angle α of at least 5°, more specifically by at least 7°, in particular by at least 10°, measured between the longitudinal axis (L1) of the lighter (1) and a longitudinal axis (L2) of the connecting device (30).
11. The lighter (1) according to one of embodiments 5 to 10, wherein the connecting device (30) comprises a first stop (33) and wherein the housing (10) comprises a second stop (32), wherein the biasing element (31) is arranged between first stop (33) and second stop (32).
12. The lighter (1) according to one of the preceding embodiments, wherein the connecting device (30) comprises a connecting body (34), more specifically a cylindrical connecting body (34), having a length (1) and a diameter (d).
13. The lighter (1) according to embodiment 12, wherein the connecting body (34) has an outer circumferential surface (341), a first end face (342) and a second end face (343).
14. The lighter (1) according to embodiment 12 or embodiment 13, wherein the connecting body (34) comprises an opening (344), defining an inner circumferential surface (345).
15. The lighter (1) according to one of embodiments 12 to 14, wherein the connecting body (34) comprises a chamfer (346) arranged between first end face (342) and outer circumferential surface (341), more specifically wherein the chamfer (346) extends at least partially over the circumference of the connecting body (34).
16. The lighter (1) according to one of embodiments 12 to 15, wherein the connecting body (34) comprises a bevel (347) arranged between the first end face (342) and the inner circumferential surface (345).
17. The lighter (1) according to one of embodiments 12 to 16, wherein the connecting body (34) comprises a recess (348) extending at least partially over the outer circumferential surface (341), more specifically wherein the recess (348) extends at least partially over the length (1) of the connecting body (34).

18. The lighter (1) according to embodiment 17, wherein the recess (348) and the chamfer (346) are substantially aligned to each other on the outer circumferential surface (341) with respect to the longitudinal axis (L2).

19. The lighter (1) according to embodiment 17 or embodiment 18, wherein the recess (348) and the chamfer (346) are oriented toward a center of the lighter (1).

20. The lighter (1) according to one of embodiments 17 to 19, wherein starting from the first end face (342) along the longitudinal axis (L2), the connecting body (34) comprises the chamfer (346), followed by a section of diameter (d), followed by the recess (348).

21. The lighter (1) according to one of embodiments 12 to 20, wherein the connecting body (34) comprises a first portion (350) proximate the first end face (342) having diameter (d) and a length (l1).

22. The lighter (1) according to one of embodiments 12 to 21, wherein the connecting body (34) comprises a second portion (351) proximate the second end face (343) having a diameter (d1) and a length (l2).

23. The lighter (1) according to embodiment 21 or embodiment 22, wherein the connecting body (34) comprises a third portion (352) arranged between the first portion (350) and the second portion (351) having a diameter (d2) and a length (l3).

24. The lighter (1) according to embodiment 22 or embodiment 23, wherein the diameter (d1) of the second portion (351) is larger than the diameter (d) of the first portion (350).

25. The lighter (1) according to embodiment 23 or embodiment 24, wherein the diameter (d2) of the third portion (352) is smaller than the diameter (d) of the first portion (350) and/or the diameter (d1) of the second portion (351).

26. The lighter (1) according to one of embodiments 12 to 25, wherein the connecting body (34) comprises a groove (36) on the outer circumferential surface (341), more specifically wherein the groove (36) extends at least partially over the circumference of the connecting body (34).

27. The lighter (1) according to embodiment 26, wherein the groove (36) is formed between first portion (350) and third portion (352).

28. The lighter (1) according to embodiment 26 or embodiment 27, wherein the connecting device (30) comprises a retaining ring (37) insertable into the groove (36).

29. The lighter (1) according to embodiment 28, wherein the first stop (33) is formed by the retaining ring (37).

30. The lighter (1) according to one of embodiments 12 to 29, wherein at least a portion of the connecting body (34) comprises a square-shaped cross-section, more specifically a square-shaped cross-section with rounded edges.

31. The lighter (1) according to embodiment 30, when dependent on embodiment 23, wherein the third portion (352) comprises the square-shaped cross-section with rounded edges.

32. The lighter (1) according to one of embodiments 12 to 31, wherein the connecting body (34) comprises a coupling member (38) arranged at the second end face (343), wherein the coupling member (38) is configured to be coupled to the nozzle (40).

33. The lighter (1) according to one of the preceding embodiments, wherein the housing (10) comprises a support element (11) configured to receive and support the connecting device (30), more specifically wherein the connecting device (30) is movably received by the support element (11).

34. The lighter according to embodiment 33, wherein the second stop (32) is formed by the support element (11), more specifically by at least a portion of a side wall of the support element (11) facing the first stop (33).

35. The lighter according to any one of embodiments 22 to 34, wherein the connecting device (30) comprises a third stop (331), more specifically wherein the third stop (331) is formed by the second portion (351).

36. The lighter according to embodiment 35, wherein in the fully extended position (P1) of the connecting device (30), the third stop (331) contacts the second stop (32), more specifically wherein the third stop (331) contacts at least a portion of a side wall of the support element (11) facing the third stop (331).

37. The lighter according to embodiment 35 or embodiment 36, wherein in a retracted position (P2) which is between the fully extended position and the fully retracted position, and/or in the fully retracted position of the connecting device (30), there is a distance ($d_{retract}$) between the second stop (32) and the third stop (331).

38. The lighter (1) according to any one of embodiments 33 to 37, wherein the support element (11) is adapted to prevent rotation of the connecting device (30) about its longitudinal axis (L2).

39. The lighter (1) according to one of embodiments 12 to 38, wherein the connecting body (34) comprises an anti-rotation element (39) on the outer circumferential surface (341).

40. The lighter (1) according to one of the preceding embodiments, wherein the connecting device (30) comprises a seal member (35), more specifically a seal bushing, wherein the seal member (35) is configured to couple to the gas and/or fuel reservoir device (20).

41. The lighter (1) according to embodiment 40, when dependent on embodiment 14, wherein the seal member (35) is arranged in the connecting body (34), more specifically in the opening (344) of the connecting body (34) proximate the first end face (342).

42. The lighter (1) according to one of the preceding embodiments, wherein the housing (10) comprises a housing recess (12) configured to receive and to support the gas and/or fuel reservoir device (20).

43. The lighter (1) according to one of the preceding embodiments, wherein the lighter (1) further comprises a lid which is designed to be coupled to the housing (10), more specifically wherein the lid is configured to cover the housing recess (12).

44. The lighter (1) according to embodiment 43, wherein the lid is designed to be coupled to the housing (10) by a positively locking connection, more specifically a snap-fit connection.

45. The lighter (1) according to embodiment 43 or embodiment 44, wherein the lid is connected to the housing (10) via a hinge.

46. The lighter (1) according to one of embodiments 43 to 45, wherein the lid comprises a tensioning element configured to apply a preload in the direction of the longitudinal axis (L1).

47. The lighter (1) according to one of the preceding embodiments, wherein the nozzle (40) comprises a nozzle outlet (41) and a conduit, more specifically wherein the conduit is coupled to the connecting device (30).

48. The lighter (1) according to embodiment 47, wherein the nozzle (40) further comprises a tubular body (42), more specifically wherein the conduit is at least partially arranged in the tubular body (42).
49. The lighter (1) according to embodiment 48, wherein the nozzle (40), more specifically the tubular body (42) of the nozzle (40), has a length (l4) of at least 3 cm, more specifically of at least 7 cm, in particular of at least 10 cm.
50. The lighter (1) according to embodiment 48 or embodiment 49, wherein the nozzle (40), more specifically the tubular body (42), has a length in the range of about 3 cm to about 25 cm, more specifically in the range of about 7 cm to about 20 cm, in particular in the range of about 10 cm to about 17 cm.
51. The lighter (1) according to one of embodiments 47 to 50, further comprising an igniter assembly (50) operatively connected to the housing (10) for generating a spark at the nozzle (40), more specifically at the nozzle outlet (41).
52. The lighter (1) according to embodiment 51, wherein the igniter assembly (50) comprises a piezoelectric mechanism (51).
53. The lighter (1) according to embodiment 52, wherein the housing (10) comprises an electrically conductive component, which is electrically coupled to the piezoelectric mechanism (51).
54. The lighter (1) according to embodiment 53, wherein the electrically conductive component is arranged between the nozzle (40) and the piezoelectric mechanism (51) to form an electrode.
55. The lighter (1) according to embodiment 53 or embodiment 54, wherein the nozzle (40) includes at least a portion with electrically conductive material which is electrically coupled to the piezoelectric mechanism (51), more specifically wherein a spark gap is formed between the nozzle (40) and the electrically conductive component.
56. The lighter (1) according to one of embodiments 53 to 55, wherein the electrically conductive component includes a tab extending toward the nozzle (40), wherein the spark gap is formed between the tab and the nozzle (40).
57. The lighter (1) according to one of embodiments 53 to 56, further comprising an electrically insulating component disposed around at least a portion of the nozzle (40) for preventing undesired sparks between the nozzle (40) and the electrically conductive component.
58. The lighter (1) according to one of embodiments 51 to 57, further comprising an actuating assembly (60) coupled to the housing (10) and configured to operatively activate the igniter assembly (50).
59. The lighter (1) according to embodiment 58, wherein the actuating assembly (60) comprises a linkage arm (61) which is operatively coupled to the igniter assembly (50) for activating the igniter assembly (50).
60. The lighter (1) according to embodiment 59, when dependent on embodiment 52, wherein the linkage arm (61), when actuated, compresses the piezoelectric mechanism (51).
61. The lighter (1) according to embodiment 59 or embodiment 60, wherein a pin (13) is rigidly connected to the housing (10) and wherein the linkage arm (61) is coupled to the pin (13), more specifically wherein the linkage arm (61) is pivotably coupled to the pin (13).
62. The lighter (1) according to one of embodiments 59 to 61, wherein the actuating assembly (60) comprises a trigger member (62) operatively coupled to the linkage arm (61).
63. The lighter (1) according to embodiment 62, wherein the igniter assembly (50) is activated when a user actuates the trigger member (62).
64. The lighter (1) according to embodiment 62 or embodiment 63, wherein the trigger member (62) extends from the housing (10) and is movable from a first, unactuated position to a second, actuated position.
65. The lighter (1) according to embodiment 64, wherein the second, actuated position comprises a first actuation step and a second actuation step subsequent to the first actuation step, wherein the linkage arm activates the igniter assembly (50) in the second actuation step.
66. The lighter (1) according to one of embodiments 62 to 65, wherein a biasing member (14) is arranged between housing (10) and actuating assembly (60), more specifically between housing (10) and trigger member (62), which is configured to urge the trigger member (62) and/or the linkage arm (61) to the first, unactuated position.
67. The lighter (1) according to one of embodiments 58 to 66, wherein the housing (10) comprises a locking element operatively coupled to the actuating assembly (60), wherein the locking element is movable between a first locking element position and a second locking element position.
68. The lighter (1) according to embodiment 67, wherein in the first locking element position, the locking element prevents operative movement of the actuating assembly (60) and wherein in the second locking element position, the locking element permits operative movement of the actuating assembly (60).
69. A lighter (1) according to one of the preceding embodiments, comprising: the gas and/or fuel reservoir device (20) coupled to the lighter (1).
70. The lighter (1) according to embodiment 69, wherein the gas and/or fuel reservoir device (20) is configured to be replaceably coupled to the lighter (1).
71. The lighter (1) according to embodiment 69 or embodiment 70, wherein the gas and/or fuel reservoir device (20) is configured to be inserted into the housing (10), more specifically wherein the gas and/or fuel reservoir device (20) is configured to be inserted into the housing recess (12).
72. The lighter (1) according to embodiment 69 to 71, wherein the gas and/or fuel reservoir device (20) comprises a fluid reservoir (21) and a valve assembly (22) for selectively dispensing fuel and/or gas.
73. The lighter (1) according to embodiment 72, wherein the valve assembly (22) comprises an adjustable valve (23) and a valve actuator (24), wherein the valve actuator (24) is coupled to the valve (23) for opening and closing the valve (23).
74. The lighter (1) according to embodiment 73, wherein the connecting device (30) is configured to be coupled to the valve assembly (22), more specifically to the adjustable valve (23), in a fluid-tight manner.
75. The lighter (1) according to embodiment 73 or 74, wherein the actuating assembly (60) coupled to the housing (10) is further configured to operatively actuate the gas and/or fuel reservoir device (20) for dispensing fuel and/or gas, more specifically to operatively actuate the valve actuator (24).

76. The lighter (1) according to one of embodiments 69 to 75, wherein the linkage arm (61) is configured to be operatively coupled to the igniter assembly (50) for activating the igniter assembly (50) and/or is configured to be operatively coupled to the gas and/or fuel reservoir device (20) for dispensing gas and/or fuel.
77. The lighter (1) according to one of embodiments 73 to 76, wherein the valve assembly (22), more specifically the valve actuator (24), is configured to be actuated by the linkage arm (61) when a user actuates the trigger member (62).
78. The lighter (1) according to embodiment 72 to 77, wherein in the first actuation step the linkage arm (61) is configured to actuate only the valve assembly (22).
79. The lighter (1) according to one of embodiments 72 to 78, wherein in the second actuation step, the linkage arm (61) is configured to actuate the valve assembly (22) and to activate the igniter assembly (50).
80. The lighter (1) according to one of embodiments 73 to 79, wherein the gas and/or fuel reservoir device (20) comprises a spring element (25) coupled to the valve actuator (24), wherein the spring element (25) urges the valve actuator (24) to an unactuated position wherein the valve (23) is closed.
81. The lighter (1) according to one of the preceding embodiments, wherein the gas and/or fuel reservoir device (20) is configured to be independently used as a lighter.
82. The lighter (1) according to embodiment 81, wherein the gas and/or fuel reservoir device (20) further comprises an ignition device (26) for generating a spark at the valve assembly (22), more specifically at the valve (23).
83. The lighter (1) according to embodiment 82, wherein the ignition device (26) comprises a spark wheel (261) coupled to the gas and/or fuel reservoir device (20) and a flint (262) coupled to the gas and/or fuel reservoir device (20), wherein the flint (262) is operatively coupled to the spark wheel (261) to generate a spark upon rotation of the spark wheel (261).
84. The lighter (1) according to embodiment 83, wherein the ignition device (26) comprises a guard member (263) adapted to prevent rotation of the spark wheel (261) in the absence of a pushing force toward the spark wheel (261), and adapted to allow rotation of the spark wheel (261) in the presence of a pushing force toward the spark wheel (261).
85. The lighter (1) according to any one of embodiments 82 to 84, wherein the valve actuator (24) is operatively coupled to the ignition device (26).
86. The lighter (1) according to any one of embodiments 82 to 85, wherein the ignition device (26) comprises a piezoelectric component which generates a spark at the valve (23) upon activation by the valve actuator (24).

| REFERENCE NUMERALS | |
|---|---|
| L1 | longitudinal axis of the lighter |
| L2 | longitudinal axis of the connecting device |
| x | longitudinal direction |
| p | perpendicular direction |
| r | radial direction |

-continued

| REFERENCE NUMERALS | |
|---|---|
| P1 | fully extended position of the connecting device |
| P2 | retracted position of the connecting device |
| P3 | retracted position of the connecting device |
| PA | imaginary pivot axis |
| FAP | force application point |
| α | angle that occurs when connecting device is pivoted |
| d | diameter of the connecting body |
| d1 | diameter of the second portion |
| d2 | diameter of the third portion |
| $d_{retract}$ | retracted distance |
| l | length of the connecting body |
| l1 | length of the first portion |
| l2 | length of the second portion |
| l3 | length of the third portion |
| l4 | length of the nozzle |
| 1 | lighter |
| 10 | housing |
| 11 | support element |
| 12 | housing recess |
| 13 | pin |
| 20 | gas and/or fuel reservoir device |
| 21 | fluid reservoir |
| 22 | valve assembly |
| 23 | valve |
| 24 | valve actuator |
| 25 | spring element |
| 26 | ignition device |
| 28 | hood |
| 30 | connecting device |
| 31 | biasing element |
| 32 | second stop |
| 33 | first stop |
| 34 | connecting body |
| 35 | seal member |
| 36 | groove |
| 37 | retaining ring |
| 38 | coupling member |
| 40 | nozzle |
| 41 | nozzle outlet |
| 42 | tubular body of the nozzle |
| 50 | igniter assembly |
| 51 | piezoelectric mechanism |
| 60 | actuating assembly |
| 61 | linkage arm |
| 62 | trigger member |
| 63 | intermediate pivoting turn rod |
| 64 | turn rod pin |
| 65 | turn rod opening |
| 211 | protrusions |
| 212 | base |
| 213 | ball |
| 231 | valve member |
| 232 | valve seat |
| 233 | rubber gasket |
| 234 | membrane |
| 235 | disk |
| 261 | spark wheel |
| 262 | flint |
| 263 | guard member |
| 264 | spring member |
| 265 | nose |
| 331 | third stop |
| 341 | outer circumferential surface |
| 342 | first end face |
| 343 | second end face |
| 344 | opening |
| 345 | inner circumferential surface |
| 346 | chamfer or slope cut |
| 347 | bevel |
| 348 | recess |

-continued

| REFERENCE NUMERALS | |
|---|---|
| 350 | first portion of the connecting body |
| 351 | second portion of the connecting body |
| 352 | third portion of the connecting body |
| 401 | protruding portion |

The invention claimed is:

1. A lighter, comprising:

a housing having a nozzle and a support element, wherein the housing is adapted to receive a fuel reservoir device; and a connecting device, the connecting device comprising a cylindrical connecting body having an outer circumferential surface, a first end face, a second end face defined by a stop, an inner circumferential surface defining an opening, and a chamfer arranged between the first end face and the outer circumferential surface, wherein the connecting device is configured to couple the fuel reservoir device to the nozzle;

wherein the connecting device is adjustable along a longitudinal axis of the lighter such that the lighter can be coupled to different fuel reservoir devices having different geometrical or structural dimensions; and wherein the stop is configured to contact the support element and prevent the connecting device from dislodging from the housing, when the connecting device is in a fully extended position.

2. The lighter of claim 1, wherein the connecting device is adjustable along the longitudinal axis by at least 0.5 mm along the longitudinal axis.

3. The lighter according to claim 1, wherein the connecting device is adjustable between the fully extended position and a fully retracted position.

4. The lighter according to claim 1, wherein the connecting device comprises a biasing element, wherein the biasing element biases the connecting device in the direction of the longitudinal axis.

5. The lighter according to claim 4, wherein the biasing element is a compression spring.

6. The lighter according to claim 1, wherein the connecting device is adjustable in a direction transverse to the longitudinal axis.

7. The lighter according to claim 1, wherein the connecting body comprises a recess extending at least partially over the outer circumferential surface.

8. The lighter according to claim 7, wherein the recess and the chamfer are substantially aligned to each other on the outer circumferential surface with respect to the longitudinal axis.

9. The lighter according to claim 7, wherein starting from the first end face along the longitudinal axis, the connecting body comprises the chamfer, followed by a section of diameter, followed by the recess.

10. The lighter according to claim 7, wherein the recess extends at least partially over a length of the connecting body.

11. The lighter according to claim 7, wherein the recess and the chamfer are oriented toward a center of the lighter.

12. The lighter according to claim 1, comprising:

the fuel reservoir device coupled to the lighter, wherein the fuel reservoir device is configured to be replaceably coupled to the lighter.

13. The lighter according to claim 1, wherein the chamfer extends at least partially over a circumference of the connecting body.

14. The lighter according to claim 1, wherein the connecting device is movably received by the support element.

15. The lighter according to claim 1, wherein the connecting device is configured to be coupled to a valve assembly for selectively dispensing fuel in a fluid-tight manner.

16. The lighter according to claim 1, wherein the opening comprises a first opening portion having a first opening diameter and a second opening portion having a second opening diameter, wherein the first opening portion and the second opening portion are fluidly coupled to each other, and wherein the first opening diameter is larger than the second opening diameter.

17. The lighter according to claim 16, wherein a seal member is arranged within the first opening portion, the seal member configured to form a fluid-tight connection between the connecting device and the fuel reservoir device.

18. The lighter according to claim 1, wherein the stop is configured to be disposed apart from the support element when the connecting device is in a fully retracted position.

19. The lighter according to claim 1, wherein, when the connecting device is in a fully extended position, the stop and the support element directly contact each other.

20. The lighter according to claim 1, wherein the connecting body comprises an anti-rotation element on the outer circumferential surface.

* * * * *